US005823716A

United States Patent [19]

Dray et al.

[11] Patent Number: 5,823,716

[45] Date of Patent: Oct. 20, 1998

[54] METHOD FOR PROVIDING ON A LANDSCAPE A SERIES OF TERRACES WITH AUGMENTED AVAILABILITY OF USABLE LEVEL SURFACE

[76] Inventors: Joseph Dray, Mevo Boomat 5; Marian Cohn, Harazim Street 28, both of 90805 MeVassaret Zion, Israel

[21] Appl. No.: 805,424

[22] Filed: Feb. 25, 1997

[51] Int. Cl.[6] ..... E02D 29/02

[52] U.S. Cl. ..... 405/258; 405/284; 405/286

[58] Field of Search ..... 405/284, 285, 405/286, 287, 262, 258, 15

[56] References Cited

U.S. PATENT DOCUMENTS

| | | | |
|---|---|---|---|
| 2,115,009 | 4/1938 | Doncaster | 405/286 |
| 2,210,218 | 8/1940 | Ramsey | 405/285 |
| 2,882,689 | 4/1959 | Huch et al. | 405/284 |
| 3,269,125 | 8/1966 | Moore | 405/15 |
| 4,278,364 | 7/1981 | Frehner | 405/284 X |
| 4,607,985 | 8/1986 | Matsushita | 405/284 |
| 4,756,645 | 7/1988 | Balzer | 405/286 X |
| 5,123,221 | 6/1992 | Legault | 405/284 X |
| 5,174,688 | 12/1992 | Meheen | 405/284 |
| 5,320,455 | 6/1994 | Mattox | 405/284 |

FOREIGN PATENT DOCUMENTS

| | | | |
|---|---|---|---|
| 0044018 | 2/1988 | Japan | 405/284 |

*Primary Examiner*—Dennis L. Taylor
*Attorney, Agent, or Firm*—Reising, Ethington, Learman & McCulloch

[57] ABSTRACT

A method for providing on a landscape a series of terraces with augmented availability of usable level surface comprising: providing an upper substantially level surface on at least one portion of said landscape; providing one or more gallery support members on the said upper level surface, each said gallery support member comprising a downwardly open upper load bearing shell defining an internal gallery volume and enclosing a first portion of said upper level surface, and further comprising at least one gallery opening in communication with a second portion of said level upper surface; depositing a quantity of landfill material over said at least one gallery support member and over at least a portion of said upper level surface, not including said first and second portions thereof, to a predetermined depth and substantially leveling at least a portion of said landfill material to provide an uppermost terrace comprising an upper level surface; optionally providing a new uppermost terrace on said uppermost terrace by repeating the second and third steps of the present method, hereinbefore defined, on the said upper level surface of said uppermost terrace obtained in the previous step of said method; optionally repeating the fourth step of the present method, hereinbefore defined, a plurality of times to provide, each time, a new uppermost terrace on the previously obtained uppermost terrace; wherein said first and second portions of each said upper level surface may optionally comprise an upper layer of a suitable material.

34 Claims, 11 Drawing Sheets

METHOD FOR PROVIDING ON A LANDSCAPE A SERIES OF TERRACES WITH AUGMENTED AVAILABILITY OF USABLE LEVEL SURFACE

FIELD OF THE INVENTION

The present invention relates to a method for terraces with augmented availability of usable level surface particularly in relation to providing additional surface suitable for the burial of human remains, and also in relation to providing additional surface for low-cost vehicle parking and various forms of husbandry.

BACKGROUND

Particularly in densely populated geographical regions having a hilly or mountainous topography, for example the city of Jerusalem and its suburbs, usable level surface is at a premium. There is a need for increasing the availability of usable surface area in a relatively inexpensive manner, and this need far from being restricted to sloping landscapes, also includes originally level landscapes as well as the valley areas between mountains and/or hills.

Usable level surface may be defined as substantially horizontal and planar land area or terrain which may be generally suitable for one or more uses such as parking facilities for road vehicles, burial of human remains, husbandry and building construction, among others. Terracing of sloping landscapes enjoys widespread success worldwide as a time-honored method used for advantageously converting sloping terrain into usable level terrain. Essentially, terracing involves the process of constructing a series of substantially horizontal offsets in a sloping landscape such as a hillside or mountainside; erosion is minimized, enabling each of the terraced areas to be used in a substantially similar manner to flat land. However, traditional terracing usually requires excavation of the sloping landscape and redistribution of excavated soil, which may be costly in terms of time, effort and finance. Furthermore, the maximum level surface area that has traditionally been achievable by the process of terracing a sloping landscape has been limited to the plan surface area thereof. Thus, a relatively inexpensive method for providing terraces having augmented availability of level surface area is clearly advantageous.

Traditionally, the concept of a building structure comprising multiple stories therein has provided augmentation of available land urea, wherein many times the original ground area is rendered available for uses such as dwellings and parking of vehicles. However, this solution represents a costly and complex investment in time, engineering effort and finance. Moreover, structures such as these do not provide an adequate solution for other purposes such as human burial, for example, nor a relatively inexpensive solution for mass road vehicle parking.

Certain types of husbandry, including the production of mushrooms and the raising of chickens on a commercial scale, are carried out in enclosed areas where full control is exercised over the environment therein, including temperature, humidity and lighting. Thus, the structures for housing said enclosed areas must be carefully shielded from external variations in climate and lighting, which may require costly insulation of said structure.

One aim of the present invention is to provide a novel method for providing terraces on a landscape with relatively low associated engineering, and financial costs.

Another aim of the present invention is to provide a method for providing terraces with augmented availability of usable level surface in a landscape.

Another aim of the present invention is to provide a method for providing terraces with augmented availability of usable level surface in a landscape, wherein said method may be advantageously applied to provide additional level surface area for purposes such as human burial.

Another aim of the present invention is to provide a method for providing terraces wit augmented availability of usable level surface in a landscape, wherein said method may be advantageously and relatively inexpensively applied to provide additional level surface area for purposes such as road vehicle parking.

Another aim of the present invention is to provide a method for providing terraces with augmented availability of usable level surface in a landscape, wherein said method may be advantageously and relatively inexpensively applied to provide additional level surface area for husbandry purposes including the production of mushrooms and the raising of chickens on a commercial scale.

Briefly, these aims are accomplished by a novel approach in the terracing of landscapes, wherein, a landscape either originally sloping or substantially level, may be terraced into a series of vertically adjacent terraces: each upper terrace therein is added onto an adjacent lower terrace by adding suitable landfill material thereto, having first provided on said lower terrace one or more gallery support structures, each having an opening in communication with said lower terrace. Thus, each upper terrace effectively comprises one or more subterranean galleries in communication with the terrace immediately below said upper terrace; furthermore, said gallery support members enclose an area of usable level surface, augmenting availability of same.

SUMMARY OF THE INVENTION

A method for providing, on a landscape a series of terraces with augmented availability of usable level surface comprising the steps of: providing an upper substantially level surface on at least one portion of said landscape; providing one or more gallery support members on the said upper level surface, each said gallery support member comprising a downwardly open upper load bearing shell defining an internal gallery volume and enclosing a first portion of said upper level surface, and further comprising at least one gallery opening in communication with a second portion of said level upper surface; depositing a quantity of landfill material over said at least one gallery support member and over at least a portion of said upper level surface, not including said first and second portions thereof, to a predetermined depth and substantially leveling at least a portion of said landfill material to provide an uppermost terrace comprising an upper level surface; optionally providing a new uppermost terrace on said uppermost terrace by repeating the second and third steps of the present method, hereinbefore defined, on the said upper level surface of said uppermost terrace obtained in the previous step of said method; optionally repeating the fourth step of the present method, hereinbefore defined, a plurality of times to provide, each time, a new uppermost terrace on the previously obtained uppermost terrace; wherein said first and second portions of each said upper level surface may optionally comprise an upper layer of a suitable material.

DETAILED DESCRIPTION

The present invention relates to a method for providing on a landscape a series of terraces with augmented availability of usable level surface comprising the steps of:

(i) providing an upper substantially level surface on at least one portion of said landscape;

(ii) providing one or more gallery support members on the said upper level surface, each said gallery support member comprising a downwardly open upper load bearing shell defining an internal gallery volume and enclosing a first portion of said upper level surface, and further comprising at least one gallery opening in communication with a second portion of said level upper surface;

(iii) depositing a quantity of landfill material over said at least one gallery support member and over at least a portion of said upper level surface, not including said first and second portions thereof, to a predetermined depth and substantially leveling at least a portion of said landfill material to provide an uppermost terrace comprising an upper level surface;

(iv) optionally providing a new uppermost terrace on said uppermost terrace by repeating steps (ii) and (iii) on the said upper level surface of said uppermost terrace obtained in the previous step of said method;

(v) optionally repeating (iv) a plurality of times to provide, each time, a new uppermost terrace on the previously obtained uppermost terrace;

wherein said first and second portions of each said upper level surface may optionally comprise an upper layer of a suitable material.

The present invention also relates to a method for providing a series of terraces with augmented availability of usable level surface, wherein said landscape comprises a substantially sloping upper surface, and said upper substantially level surface on said at least one portion of said landscape is provided by depositing a quantity of suitable landfill material on at least said one portion of said landscape to form a lowermost terrace abutting at least a portion of said sloping upper surface of said landscape, wherein said lowermost terrace comprises an upper level surface.

The present invention also relates to a method for providing a series of terraces with augmented availability of usable level surface, wherein said landscape comprising a substantially sloping upper surface constitutes a portion of a hill or a mountainside or a suitable mound of landfill material.

The present invention also relates to a method for providing a series of terraces with augmented availability of usable level surface, wherein said at least one gallery opening is provided in a direction generally opposed to the said landscape.

The present invention also relates to a method for providing a series of terraces with augmented availability of usable level, wherein each said new uppermost terrace abuts said sloping landscape.

Figure 1A:
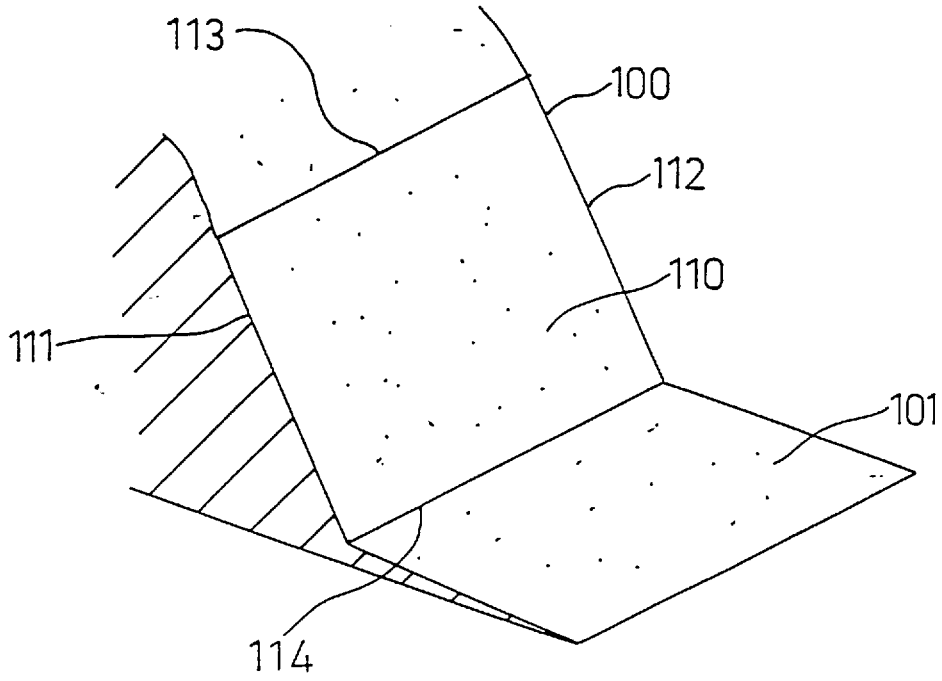
FIGS. 1(*a*) and 1(*b*) illustrates, in perspective view, the first step of the method of the present invention applied to a portion of a sloping landscape.
Figure 1B:
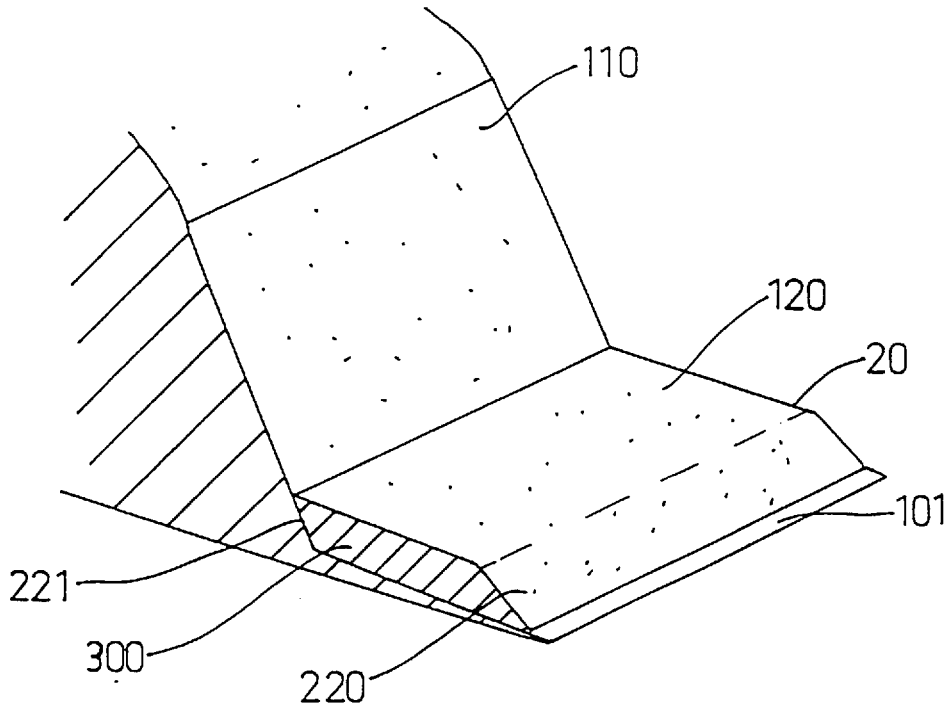
Figure 2A:
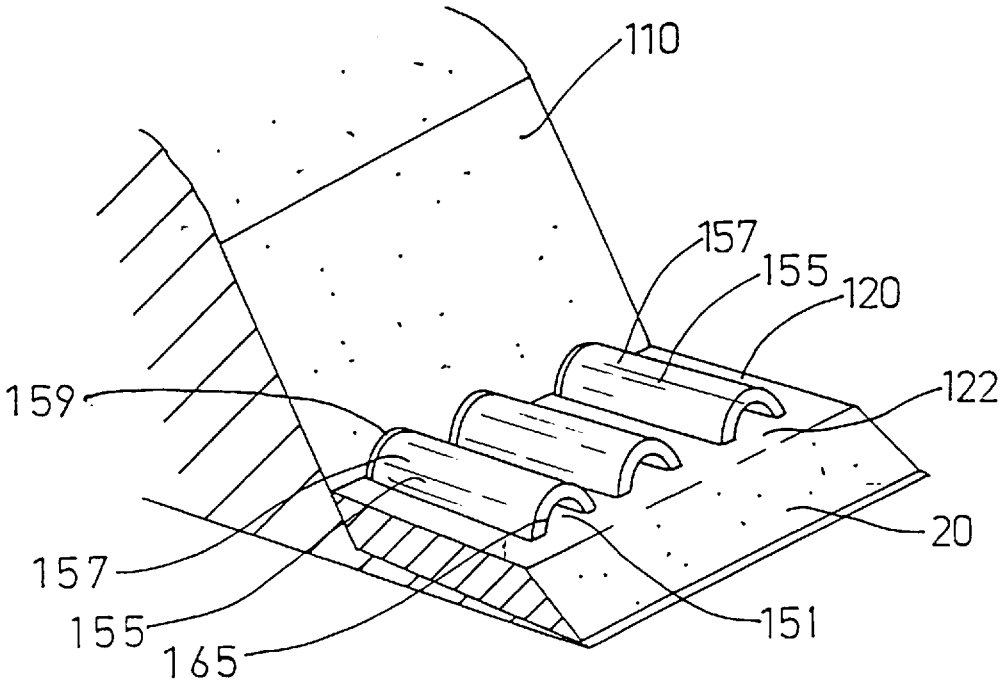
FIGS. 2(*a*) and 2(*b*) illustrate, in perspective view, the second and third steps of the method of the present invention applied to the landscape of FIG. 1(*b*).
Figure 2B:
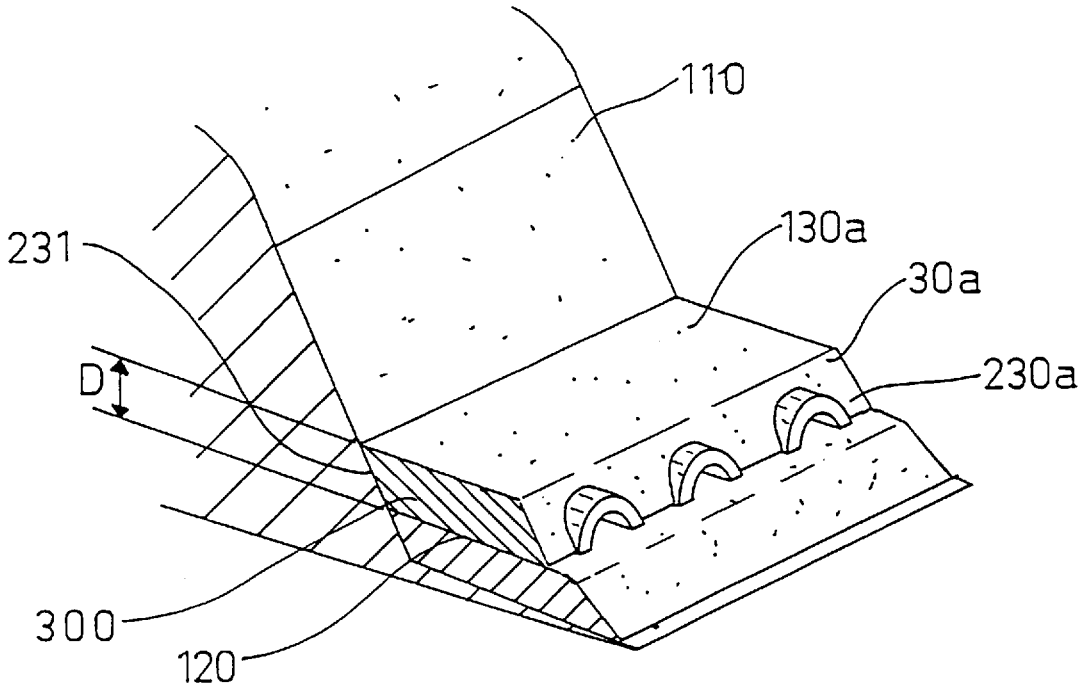
Figure 3A:
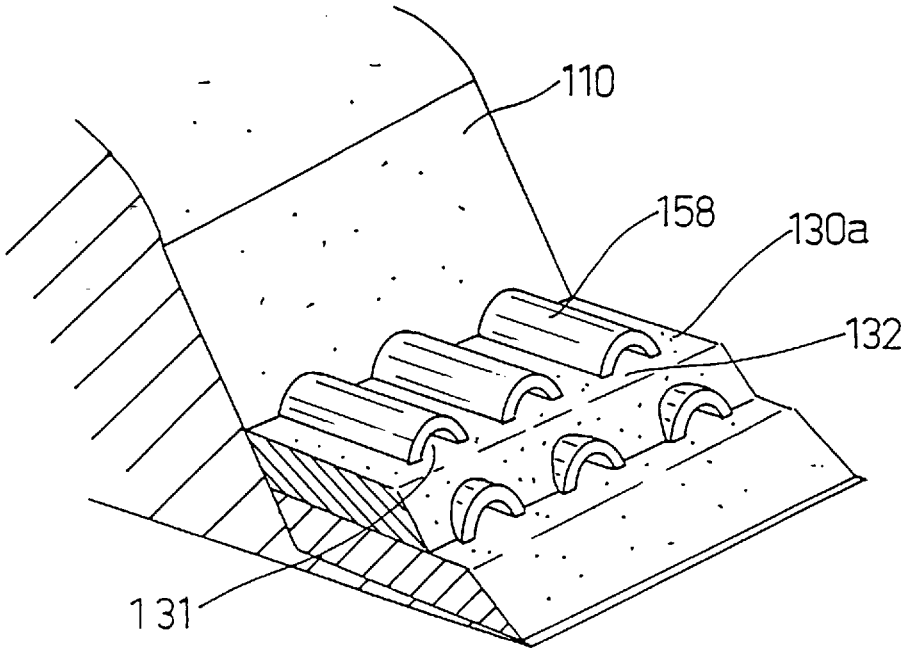
FIGS. 3(*a*) and 3(*b*) illustrate, in perspective view, the final steps of the method of the present invention applied to the landscape of FIG. 2(*b*).
Figure 3B:
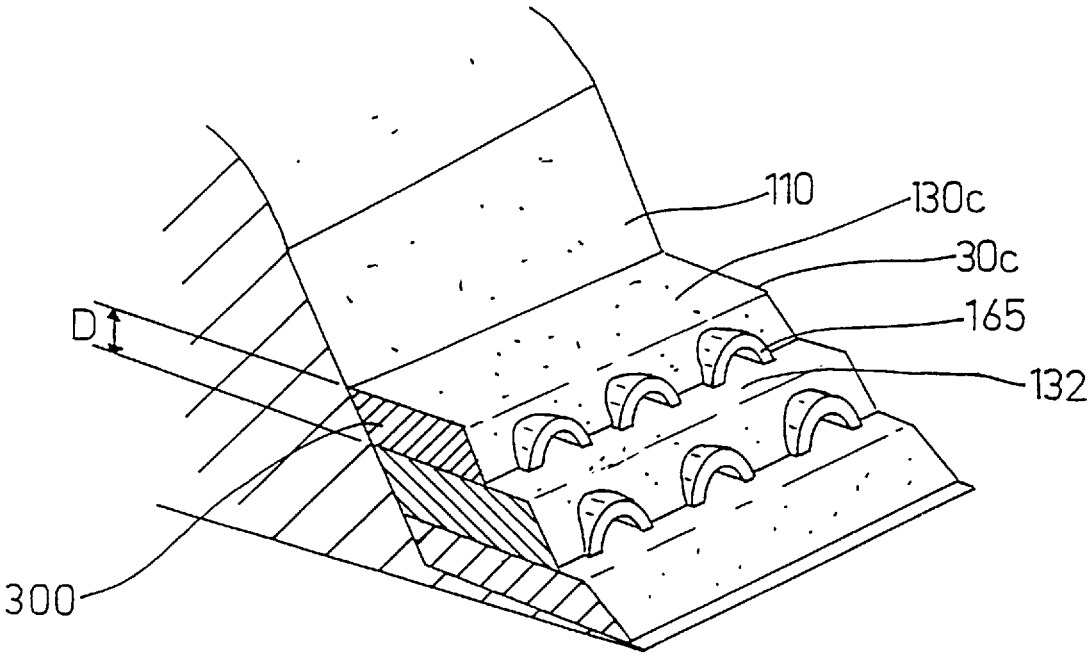

Thus, with reference to FIGS. 1 to 3, a representative tract 110 of sloping landscape is illustrated, having a boundary 100 wherein the method of providing terraces with augmented availability of usable surface, according to the present invention, is to be applied. For the purpose of example, said tract is a rectangular section representative of a sloping landscape, comprising sloping borders 111 and 112, and an upper border 113 and a lower border 114, though the method of the current invention may be applied to any other suitable sloping landscape constituting at least a portion of a hill, mountainside, or suitable mound of landfill, and may be easily adapted to a previously terraced landscape. For simplicity, lower border 114 is shown adjacent to a lower section 101 of the landscape having a lower gradient; said section 101 may represent, for example, the foot of a mountain or a valley.

Figure 4:
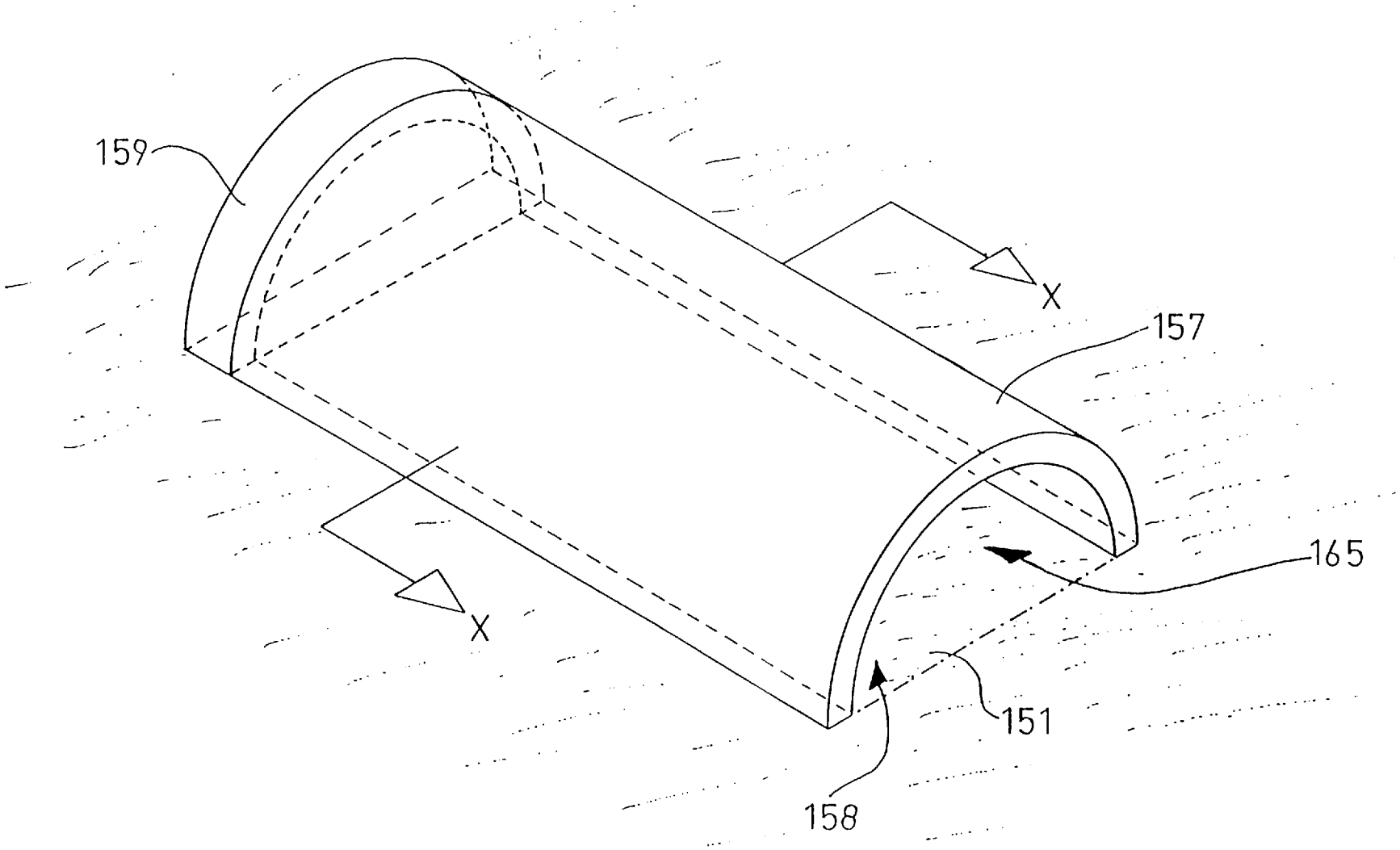
FIG. 4 illustrates, in perspective view, a preferred embodiment of the gallery support members according to the present invention.
Figure 5A:
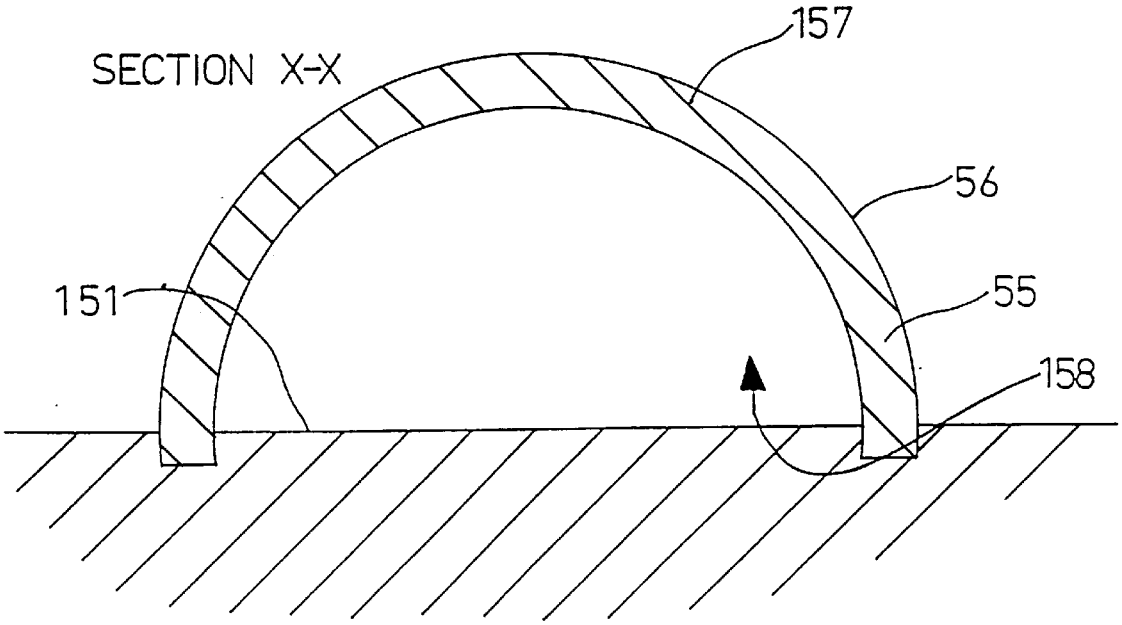
FIGS. 5(*a*) and 5(*b*) illustrate alternative cross-sectional profiles of the galleries comprises in the terraced landscape of FIG. 4.
Figure 5B:
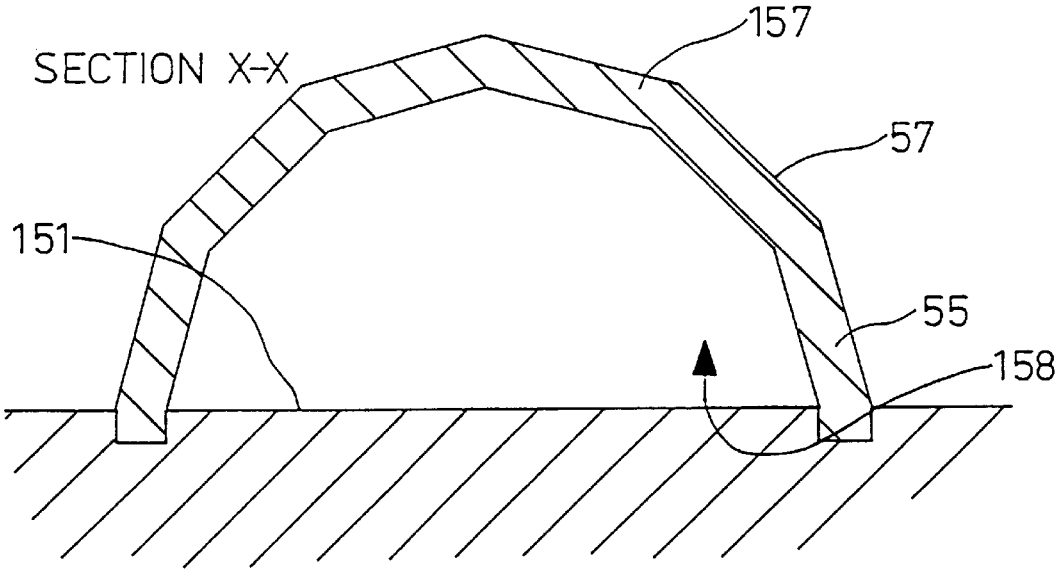

A quantity of suitable landfill material 300 is deposited on said lower section 101 and near the lower border 114 of said tract 110 to provide a lowermost terrace 20, said material 300 being leveled off to provide a substantially level surface 120. Said landfill material 300 may include soil, for example, advantageously originating from excavation operations on oil building sites during the course of constructing building foundations, and may also include any other suitable material. Said lowermost terrace 20 on one side 221 abuts said tract 110 and is bounded elsewhere by a periphery 220 having a suitable slope to maintain stability. Preferably, said periphery 220 comprises a retaining wall 320 to minimize erosion of said material 300. Next, referring to FIG. 2(*a*), one or more gallery support members 155 are provided on the said upper level surface. Each said gallery support member 155 comprises a downwardly open upper load bearing shell defining an internal gallery volume and encloses a portion 151 of said upper level surface 120. Said gallery support member 155 further comprises a gallery opening in a direction generally opposed to said tract 110 and in communication with at least a portion 122 of said level upper surface 120. Thus, said enclosed first portion 151 of said upper level surface 120 is substantially coplanar with at least a portion of said level surface 120 of terrace 20. In a preferred embodiment, with reference to FIGS. 4 and 5, each said gallery support member 155 comprises a substantially horizontal generally semi-cylindrical longitudinal upper shell 157, having an open bottom 158, and constant transverse cross section 55, with a closed horizontal end 159 and a horizontal opening 165. Thus, when laid on sail upper surface 120, said upper shell 157 encloses a rectangular portion 151 thereof and an internal gallery volume accessible via opening 165. Said cross-section 55 may comprise an arcuate profile 56 upwards of said portion 151. Alternatively, said cross section may comprise a polygonal profile 51, or any other suitable profile, upwards of said portion 151. In a preferred embodiment, said upper shell 157 comprises a reinforced concrete construction—through other materials known in the art may be suitable—and is precast, or alternatively, may be cast in situ, though other methods for constructing said upper shells 157 may in addition also be appropriate. In the present example, three upper shells 157 are laid on paid upper level surface 120, parallel to each other, the closed horizontal ends 159 preferably abutting said tract 110, and the horizontal openings 165 thus facing a direction opposed to said tract 110.

Referring to FIG. 2(*b*), a quantity of said landfill material 300 is then deposited over said upper shells 157 and over the upper level surface 120, excluding the portions 151 thereof enclosed by said shells 157, as well as said portion 122, being an access area of said upper level surface 120 in communication with said openings 165. Said landfill material 300 is deposited and leveled to a predetermined depth "D", preferably at least 4.0 meters, to provide an uppermost terrace 30*a* having a substantially level surface 130*a*. One side 231 of said terrace 30*a* abuts said tract 110, and is bounded elsewhere by a periphery 230*a* having a suitable slope to maintain stability. A common retaining wall may be provided between each successive upper terrace and corresponding lower terrace, wherein said gallery opening may be provided on said retaining wall. Thus, preferably, said periphery 230*a* comprises a retaining wall to minimize erosion of said material 300. Said retaining wall may comprise a planar reinforced concrete construction and have appropriate openings thereon corresponding to said openings 165.

In a similar manner, terrace after terrace may be provided on said tract 110, each time laying one or more gallery support members 155, and depositing a quantity of said landfill material 300 to a predetermined depth as described above. Thus in the present example, and with reference to FIG. 3, a further three upper shells 158, which are preferably substantially identical to upper shells 157, but may be of different dimensions and/or cross-sectional profiles, are laid in parallel on said upper surface 130*a*, enclosing each therein a portion 131 thereof. Said landfill material 300 is deposited over said upper surface 130*a* and corresponding shells 158, excluding said corresponding portions 131 and a further portion thereof 132 in communication with the corresponding opening 165, thereby providing a new uppermost terrace 30*c*, having an upper level surface 130*c*. This procedure may thus be applied as often as may be appropriate given the physical constraints of the tract 110.

Figure 6:
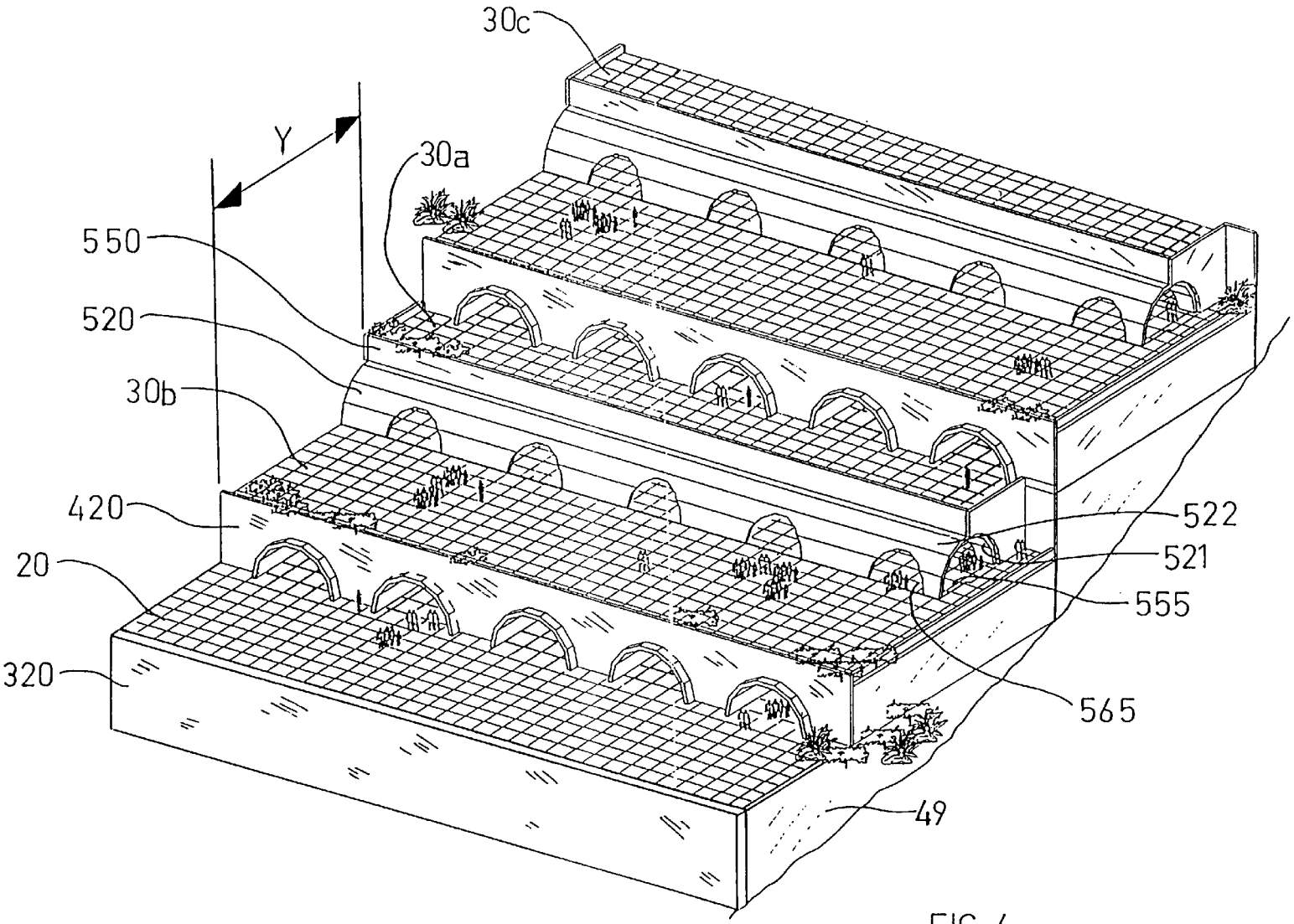
FIG. 6 illustrates, in perspective view, a landscape terraced according to the method of the present invention, further comprising subsidiary terraces.
Figure 7:
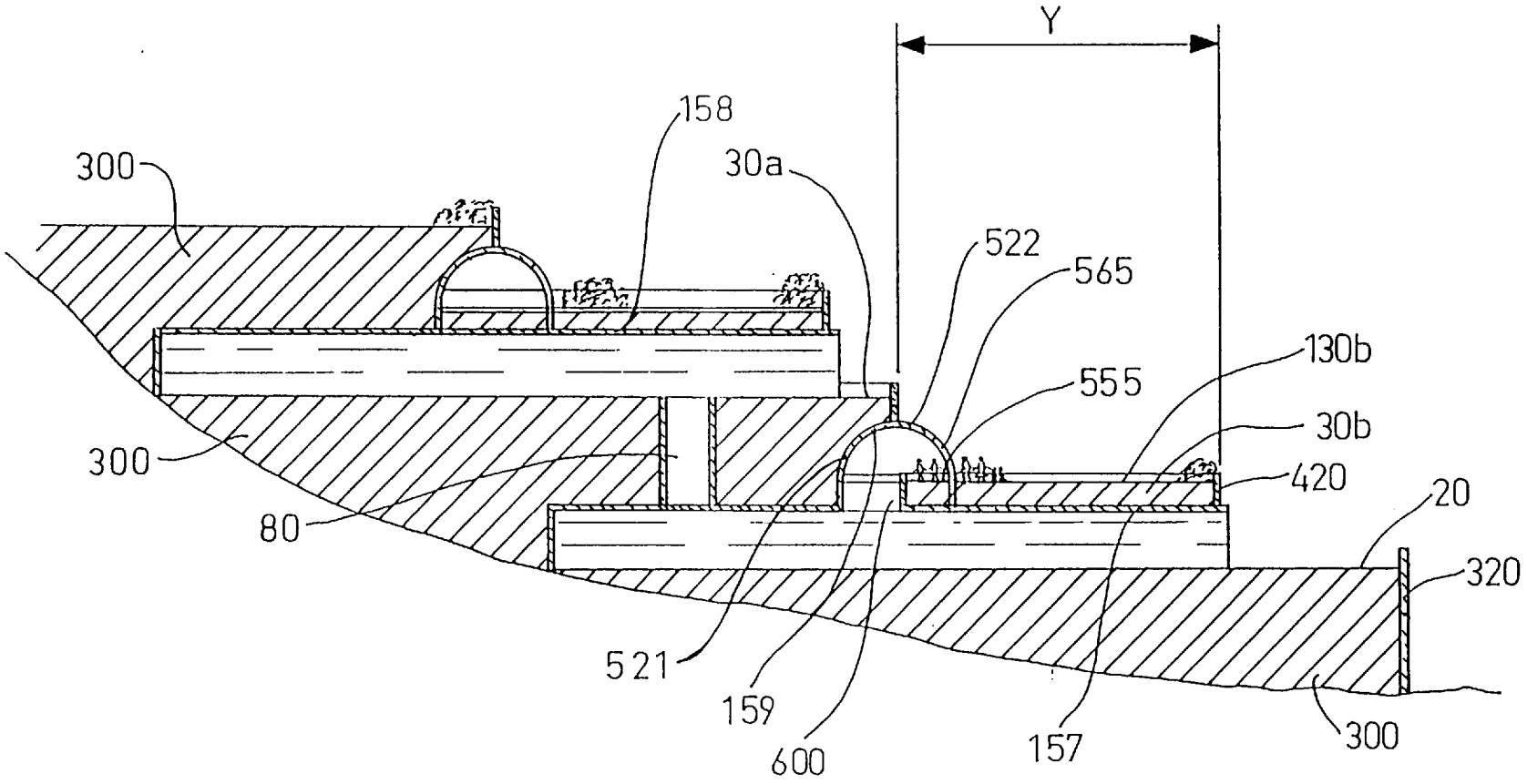
FIG. 7 illustrates, in side sectional view, the terraced landscape of FIG. 6.

In another example of the method of the present invention, and referring to FIGS. 6 and 7, a sub-terrace, e.g. 30*b*, may optionally be provided between vertically adjacent terraces, e.g. 20 and 30*a*. Thus, terrace 30*a* may be recessed by an offset "Y" relative to terrace 20, providing more exposed terrace surface, i.e. portion 122, generally at the expense of the enclosed portions 151. Preferably, sub-terrace 30*b* comprises a minimum depth, as defined between the surface 130*b* thereof and the top of the shells 157, of 1.5 meters. Sub-terracing may be desirable where landfill material 300 is in short supply, for example, or to facilitate provision of natural light to the closed ends 159 of the said shells 157 or 158. In this example, a retaining wall 420 is provided between terrace 20 and sub-terrace 30*b*, and a further retaining wall 520 is provided between sub-terrace 30*b* and corresponding adjacent terrace 30*a*. Preferably, retaining wall 420 comprises a planar reinforced concrete construction, having appropriate openings thereon corresponding to said openings 165. Retaining wall 520 may be similarly configured, though advantageously comprises a longitudinal semi-cylindrical upper shell 159 similar to said shells 157 and 158, wherein said shell 159 is located between terrace 30*a* and sub-terrace 30*b* with its longitudinal axis substantially parallel to the edge 550 of terrace 30*a*. Thus, shell 159 is orthogonally oriented to and directly above, shells 157 located on terrace 20, as hereinbefore described. Approximately one lateral half 521 of said shell 159 is in loadbearing contact with the landfill material 300 comprising terrace 30*a*. The exposed lateral half 522 of said shell 159 may optionally further comprise a series of openings 565 for access into the enclosed surface therein from said sub-terrace 30*b*. Each of the shells 157 may thus be provided with a skylight 600 whereby to provide communication between the gallery volume within said shells 157 and said shell 159, wherein the strategic location of openings 565 in relation to said skylights 600 enable natural light, when present, to penetrate and reach at least part of the said gallery volume. Optionally or additionally, said shells 157 comprise means for providing artificial light therein, in particular for the deeper areas thereof.

In a similar manner, a sub-terrace may be provided between each pair of vertically adjacent terraces.

Optionally, a lateral retaining wall 49 may also be provided at one or both lateral ends of each terrace and/or sub-terrace. Said retaining walls 320, 420, 520 and 49 are particularly advantageous where there is some likelihood of significant erosion, for example due to climatic conditions of high precipitation, and/or where the terrain 110 is composed of loose soil, sand or aggregate.

Optionally, the upper shells 157 on terrace 20 may be advantageously interconnected by means of similar subsidiary support members orthogonally laid and suitably connected with respect to said shells 157, to provide subsidiary galleries, prior to depositing said landfill material 300, as hereinbefore described. Similarly, the upper shells in each terrace may be advantageously interconnected in the same manner.

Optionally, said shells 157, laid on terrace 20, may be mutually interconnected with said shells 158, laid on vertically adjacent terrace 30*a*, by means of vertical access shafts 80 comprising, for example stairs, ladders or elevators. Similarly, the gallery support members between any vertically adjacent pair of terraces may also be interconnected.

Said method according to the present invention for providing a series of terraces with augmented availability of usable level surface may be advantageously applied for augmenting surface area suitable for human burial. Thus, said material 300 preferably constitutes a material suitable for burying therein human remains, including soil. Hence a cemetery, or part thereof, may be constructed on a slopping hillside or mountain side according to the method of the present invention, wherein not only the portions 122 and 132 of terraces 20 and 30*a* respectively, and optionally surface 130*b* of sub-terrace 30*b* are available for human burial, as is the current practice, but also the enclosed areas 151 and 131 by each said shells, 157 and 158 respectively, (and also the corresponding enclosed area given by each subsidiary support members interconnecting said shells 157 or 158) are also suitable and available for human burial. Hence the level surface area available for human burial may be significantly augmented by a factor N, where, depending on the number of terraces comprising subterranean galleries and subsidiary galleries, as well as the depths thereof, said factor N may exceed 200% of the sum of the level surface areas 122, 132 and 130*b*, available in the terraces 20, 30*a* and 30*b*, respectively.

Figure 8:
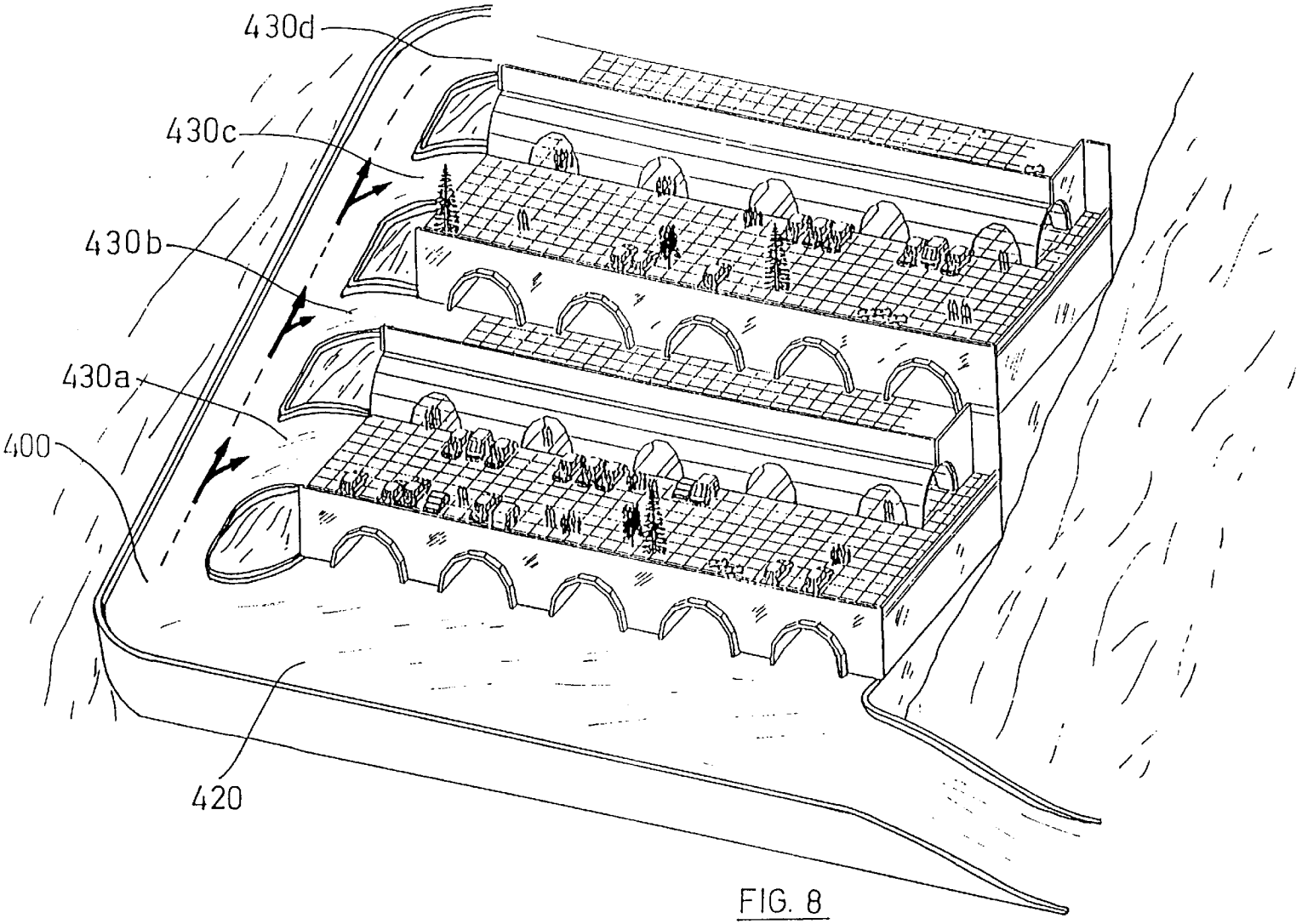
FIG. 8 illustrates, in perspective view, a landscape terraced according to the method of the present invention, as applied to the purpose of road vehicle parking.

Similarly, said method according to the present invention for providing a series of terraces with augmented availability of usable level surface may also be advantageously applied for augmenting surface area suitable for road vehicle parking, wherein said portions 122 and 132 of terraces 20 and 30*a* respectively, and optionally surface 130*b* of subterrace 30*b*, as well as the enclosed areas 151 and 131 by each said shells, 157 and 158 respectively, (and also the corresponding enclosed area given by each subsidiary support members interconnecting said shells 157 and 158) are each provided with an upper layer of a suitable loadbearing material. Preferably, said loadbearing material constitutes a suitable material for bearing corresponding static and dynamic loads thereon, and includes soil, tarmacadam and concrete. Thus, available surface for parking vehicles therein may be similarly augmented by a factor of 200%, for example, using the method of the present invention. Advantageously, as illustrated in FIG. 8, an access path or road 400, having branches 420, 430*a*, 430*b*, 430*c* and 430*d*, communicating with terraces 20, 30*a*, 30*b*, 30*c* and 30*d*, respectively, may be provided to allow vehicles convenient access to and from said terraces.

Said method according to the present invention for providing a series of terraces with augmented availability of usable level surface may also be advantageously applied for augmenting surface area suitable for at least some forms of husbandry purposes. In particular, the said shells 157 and 158, and corresponding subsidiary galleries, may provide a relatively easily controllable environment, in terms of penetration or natural light, temperature and humidity, for said husbandry purposes, particularly, in relation to the production of mushrooms and the raising of chickens on a commercial scale.

The present invention also relates to an originally sloping landscape provided with a series of terraces with augmented availability of usable surface obtained by the method substantially as hereinbefore described.

The method of the present invention is also readily adaptable to other types of landscapes, including substantially planar landscapes and, among others, to landscapes comprising the valley area between at least two opposed sloping landscapes, for example mountains and/or hills.

Figure 9A:
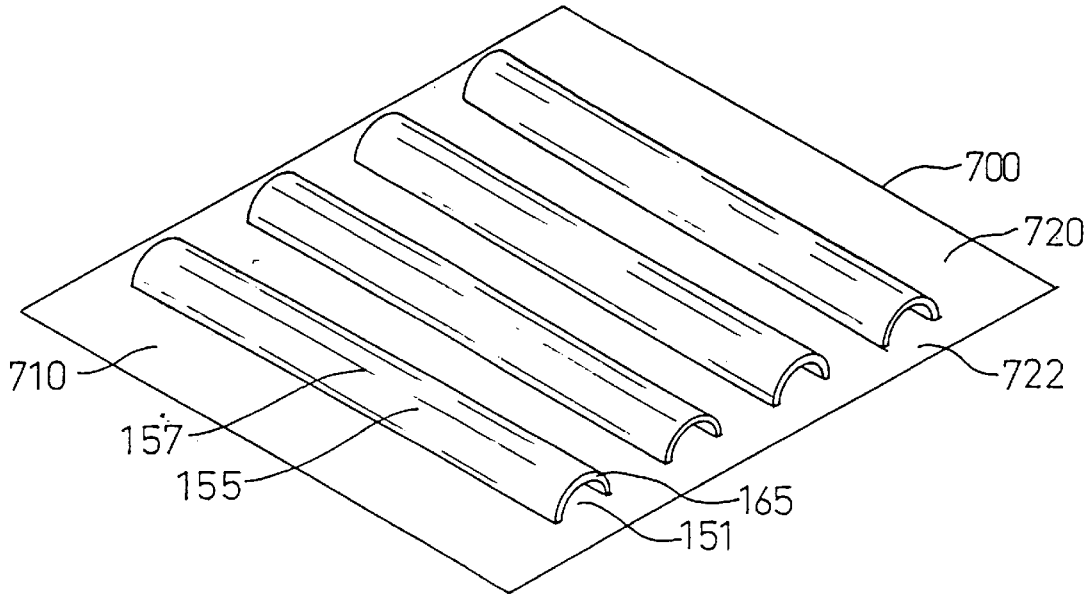
FIGS. 9(*a*) and 9(*b*) illustrate, in perspective view, the second and third steps of method of the present invention applied to a portion of a substantially level landscape.
Figure 9B:
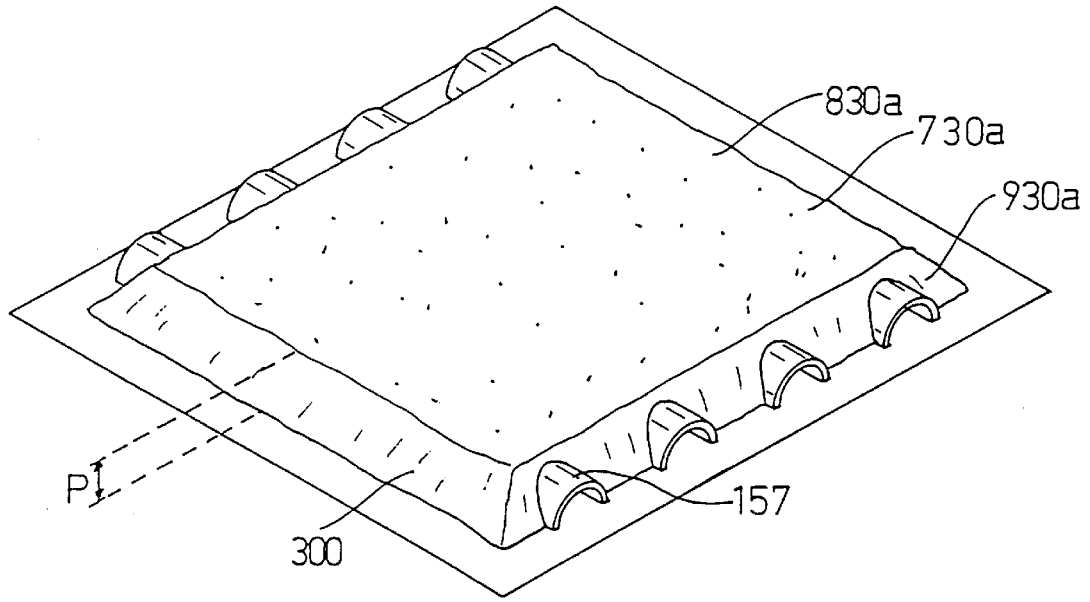
Figure 10A:
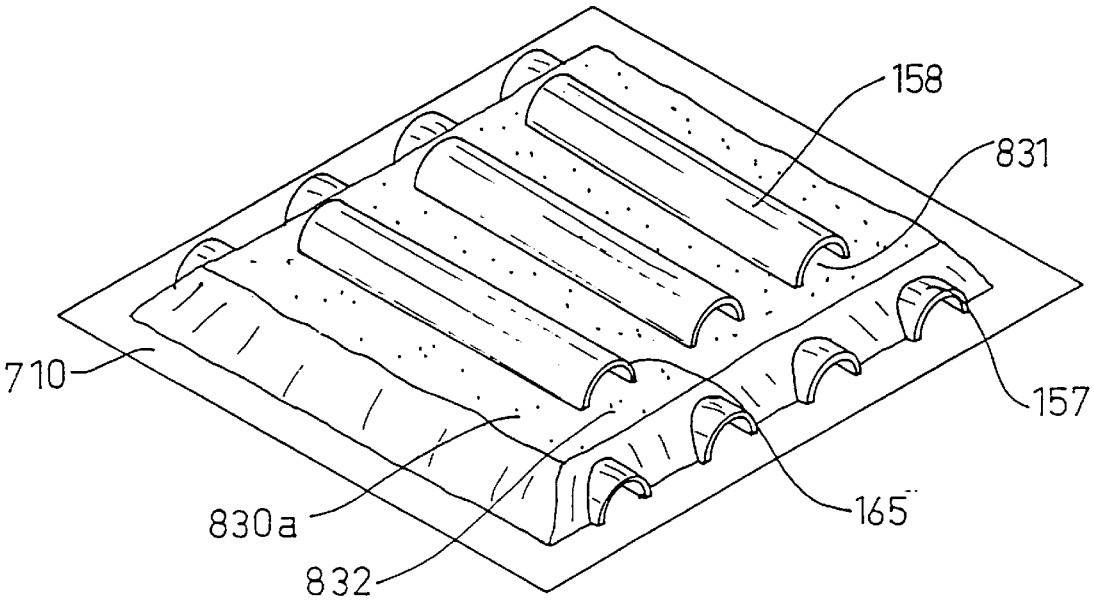
FIGS. 10(*a*) and 10(*b*) illustrate, in perspective view, the fourth step of the method of the present invention applied to the landscape of FIGS. 9(*a*) and 9(*b*).
Figure 10B:
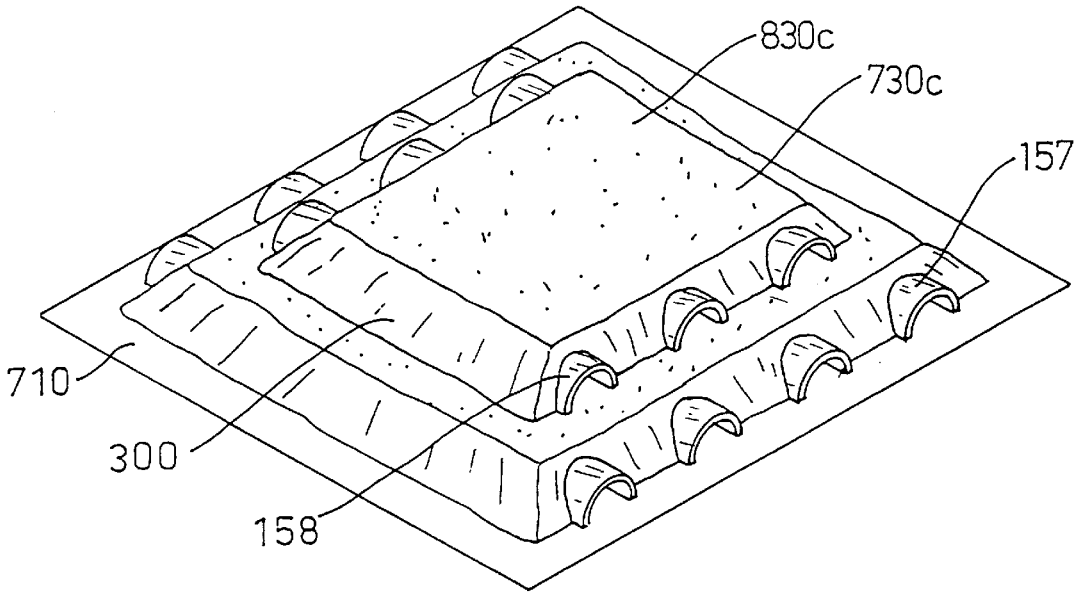
Figure 11A:
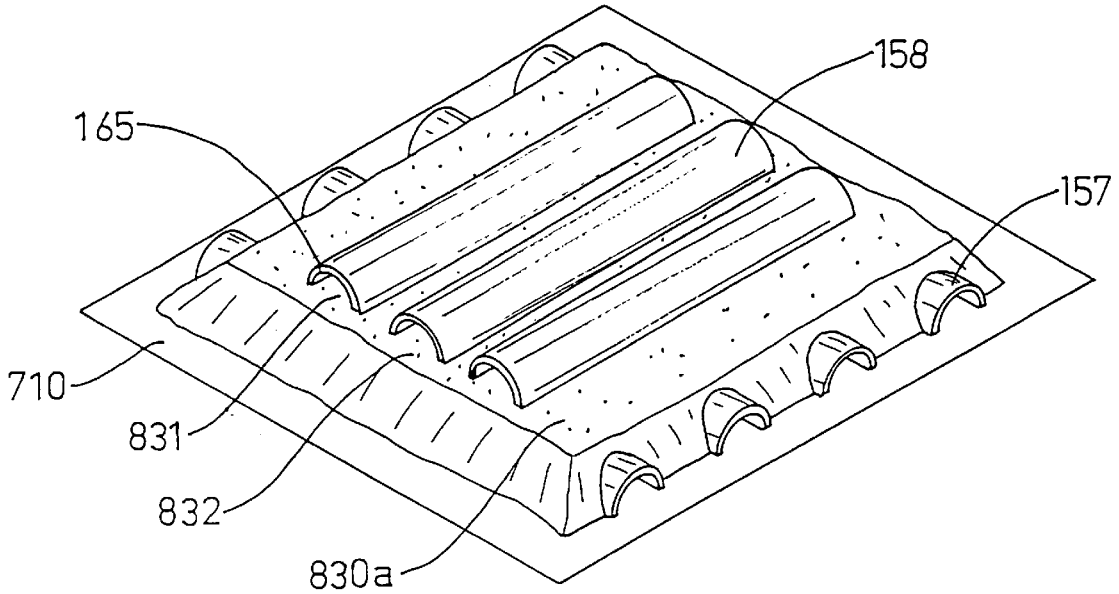
FIGS. 11(*a*) and 11(*b*) illustrate, in perspective view, the fourth step of the method of the present invention applied to the landscape of FIGS. 9(*a*) and 9(*b*).
Figure 11B:
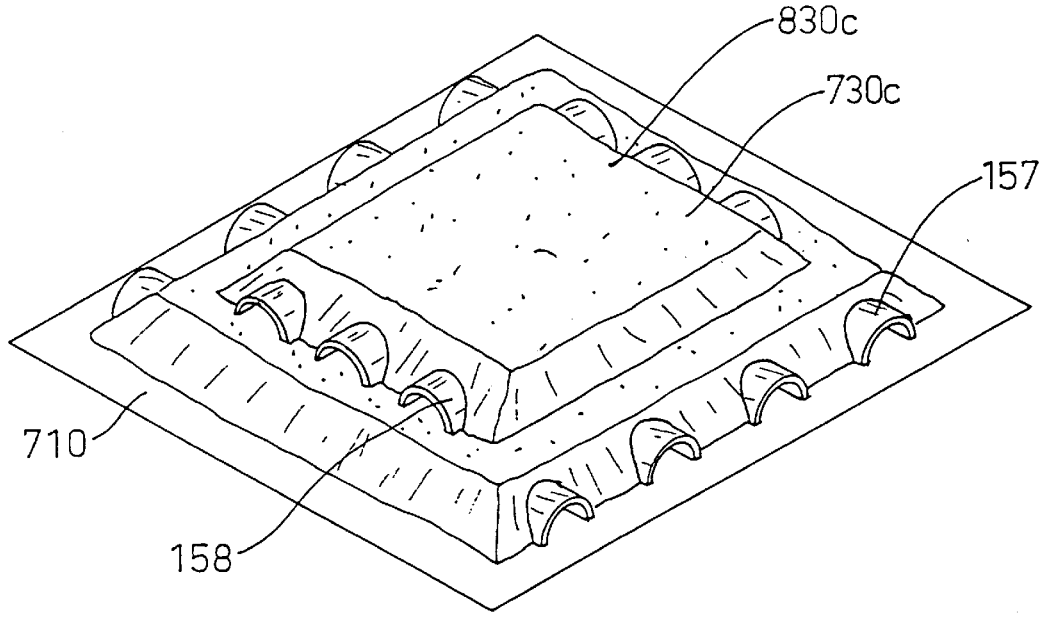

Thus, with reference to FIGS. 9 to 11, a representative tract 710 of landscape is provided, and is illustrated as having a boundary 700 and an upper surface 720 wherein the method of providing terraces with augmented availability of usable surface, according to another aspect of the present invention, is to be applied. For the purpose of example, said tract comprises a rectangular boundary, though the method of the present invention may be applied to any other suitable landscape constituting at least a portion of substantially level land, on the area of land in the valley between two or more mountains and/or hills. If the said tract is not substantially level, known methods in that art may be employed for leveling said tract 710, including, e.g., landfilling.

Referring to FIG. 9(*a*) one or more gallery support members 155, as hereinbefore described, are provided on the said upper level surface. Each said gallery support member 155 comprises a downwardly open upper load bearing shell defining an internal gallery volume and encloses a portion 151 of said upper level surface 720. Said gallery support member 155 further comprises at least one gallery opening in communication with at least a portion 722 of said level upper surface 720. Thus, said enclosed first portion 151 of said upper level surface 720 is substantially coplanar with at least a portion of said level surface 720 of tract 710. In a preferred embodiment, each said gallery support member 155 comprises a substantially horizontal generally semi-cylindrical longitudinal upper shell 157, as described hereinbefore and with reference to FIGS. 4 and 5, having at least one opening 165. In the present example, four upper shells 157 are laid on said upper level surface 720, parallel to each other, each having openings 165 at either ends of said shells 157.

Referring to FIG. 9(*b*), a quantity of said landfill material 300 is then deposited over said upper shells 157 and over the upper level surface 720, excluding portions 151 thereof enclosed by said shells 157, as well as said portion 722, being an access area of said upper level surface 720 in communication with said openings 165. Said landfill material 300 is deposited and leveled to predetermined depth "P", preferably at least 4.0 meters, to provide an uppermost terrace 730*a* having a substantially level surface 830*a*. a periphery 930*a* having a suitable slope to maintain stability surrounds said terrace 730*a*. A common retaining wall (not shown) may be provided between each successive upper terrace and corresponding adjacent lower terrace, wherein gallery openings may be providing on the retaining wall. Thus, preferably, said periphery 930*a* comprises a retaining wall to minimize erosion of said material 300. This retaining wall may comprise a planar reinforced concrete construction and have appropriate openings thereon corresponding to said openings 165.

In a similar manner, terrace after terrace may be provided on said tract 710, each time laying one or more gallery support members 155, and depositing a quantity of said landfill material 300 to a predetermined depth as hereinbefore described. Thus in the present example, and with reference to FIGS. 10 or 11, a further three upper shells 158, which are preferably substantially identical to upper shells 157, but may be of different dimensions and/or cross-sections, are laid parallel to each other on said upper surface 930*a*, each said shell 158 enclosing therein a portion 831 of the said surface 830*a*. FIG. 10, illustrates the method according to this aspect of the invention, wherein each successive layer of said loadbearing shells, 157 or 158, is oriented in a substantially parallel manner with respect to a lower adjacent layer of said loadbearing shells. FIG. 11 illustrates the method according to this aspect of the invention, wherein each successive layer of said loadbearing shells, 157 or 159, is oriented substantially orthogonally with respect to a lower adjacent layer of said loadbearing shells, thereby providing greater stability. Said landfill material 300 is deposited over said upper surface 830*a* and corresponding shells 158, excluding said corresponding portions 831 and a further portion thereof 832 in communication with the corresponding openings 165, thereby providing a new uppermost terrace 730*c*, having an upper level surface 830*c*. In general, especially if retaining walls are not used around the periphery of each successive upper terrace, the number of shells, 157 or 158, in each successive upper terrace will typically diminish, resulting in a pyramidal-type structure. Of course, when the method of the present invention, according to this aspect, is applied to the valley area between adjacent mountains or hills, the converse may be true, as each successive upper terrace is formed between substantially diverging slopes of the said mountains or hills. This procedure may thus be applied as often as may be appropriate depending on a number of factors including the physical constraints of the tract 710, the proximity of shells 157, or 158, to each other in each upper surface, the depth "P", and whether or not a retaining wall is used around the periphery of each terrace.

In another example of the method of the present invention, a sub-terrace may optionally be provided between vertically adjacent terraces, in a similar manner to that described hereinbefore with respect to FIGS. 6 and 7. In a similar manner, a sub-terrace may be provided between each pair of vertically adjacent terraces.

Optionally, the upper shells 157 on tract 710 may be advantageously interconnected by means of similar subsidiary support members orthogonally laid and suitably connected with respect to said shells 157, to provide subsidiary galleries prior to depositing said landfill material 300, as hereinbefore described. Similarly, the upper shells in each terrace may be advantageously interconnected in the same manner.

Optionally, said shells 157, laid on tract 710, may be mutually interconnected with said shells 158, laid on vertically adjacent terrace 730*a*, by means of vertical access shafts (not shown) comprising, for example stairs, ladders or elevators. Similarly, the gallery support members between any vertically adjacent pair of terraces may also be interconnected.

Said method according to the present invention for providing a series of terraces with augmented availability of usable level surface may be advantageously applied for augmenting surface area suitable for human burial. Thus, said material 300 preferably constitutes a material suitable for burying therein human remains, including soil. Hence a cemetery or part thereof, may be constructed on substantially level land or the valley area between mountains and/or hills according to this aspect of the method of the present invention, wherein the portions 722 and 832 of tract 710 and terrace 730*a* respectively (optionally including corresponding surfaces of sub-terraces therein), the enclosed areas 151 and 831 by each said shells, 157 and 158 respectively, (and also the corresponding enclosed area given by each optional subsidiary support member interconnecting said shells 157 or 158) are also suitable and available for human burial. Hence the level surface area available for human burial may be significantly augmented by a factor M, where, depending on the number of terraces comprising subterranean galleries and subsidiary galleries, as well as the depths thereof, said factor M may exceed 200% of the level surface area of the original tract 710.

Similarly, said method according to the present invention for providing a series of terraces with augmented availability of usable level surface may also be advantageously applied for augmenting surface area suitable for road vehicle parking. Thus, a road vehicle parking zone may be constructed on substantially level land or the valley area between mountains and/or hills according to this aspect of the method of the present invention wherein said portions 722 and 832 of tract 710 and terrace 730*a* respectively (optionally including corresponding surfaces of sub-terraces therein) as well as the enclosed areas 151 and 831 by each said shells, 157 and 158 respectively, (and also the corresponding enclosed area given by each subsidiary support members interconnecting said shells 157 or 158) are each provided with an upper layer of a suitable loadbearing material. Preferably, said loadbearing material constitutes a suitable material for bearing corresponding static and dynamic loads thereon, including soil, tarmacadam and concrete. Thus, available surface for parking vehicles therein may be similarly augmented by a factor of 200%, for example, using the method of the present invention. Advantageously, an access path or road, having branches, communicating with each terrace, may be provided to allow vehicles convenient access to and from said terraces, in a similar manner to the example illustrated with reference to FIG. 8.

Similarly, said method according to this aspect of the present invention for providing a series of terraces with augmented availability of usable level surface may also be advantageously applied for augmenting surface area suitable for at least some forms of husbandry purposes. In particular, the said shells 157 and 158, and corresponding subsidiary galleries, may provide a relatively easily controllable environment, in terms of penetration of natural light, temperature and humidity, for said husbandry purposes, particularly, in relation to the production of mushrooms and the raising of chickens on a commercial scale.

The present invention also relates to an originally substantially planar landscape provided with a series of terraces with augmented availability of usable level surface obtained by the method substantially as hereinbefore described.

The present invention also relates to a landscape originally comprising at least a portion of a valley between adjacent mountains and/or hills provided with a series of terraces with augmented availability of usable level surface obtained by the method substantially as hereinbefore described.

Although only a few examples of the method of the present invention have been described in detail in the foregoing description, the present invention is not limited thereto, and is only defined by the scope of the appended claims.

We claim:

1. A method for providing on a landscape a series of terraces with augmented availability of usable level surface comprising the steps of:

(i) providing an upper substantially level surface on at least one portion of said landscape;

(ii) providing one or more gallery support members on the said upper level surface, each said gallery support member comprising a downwardly open upper load bearing shell defining an internal gallery volume and enclosing a first portion of said upper level surface, and further comprising at least one gallery opening in communication with a second portion of said level upper surface;

(iii) depositing a quantity of landfill material over said at least one gallery support member and over at least a portion of said upper level surface, not including said first and second portions thereof, to a predetermined depth and substantially leveling at least a portion of said landfill material to provide an uppermost terrace comprising an upper level surface;

(iv) optionally providing a new uppermost terrace on said uppermost terrace by repeating steps (ii) and (iii) on the said upper level surface of said uppermost terrace obtained in the previous step of said method;

(v) optionally repeating (iv) a plurality of times to provide, each time, a new uppermost terrace on the previously obtained uppermost terrace;

wherein said first and second portions of each said upper level surface may optionally comprise an upper layer of a suitable material.

2. A method for providing a series of terraces with augmented availability of usable level surface as claimed in claim 1, wherein said landscape comprises a substantially sloping upper surface, and said upper substantially level surface on said at least one portion of said landscape is provided by depositing a quantity of suitable landfill material on at least said one portion of said landscape to form a lowermost terrace abutting at least a portion of said sloping upper surface of said landscape, wherein said lowermost terrace comprises an upper level surface.

3. A method for providing a series of terraces with augmented availability of usable level surface as claimed in claim 2, wherein said landscape comprising a substantially sloping upper surface constitutes a portion of a hill or a mountainside or a suitable mound of landfill material.

4. A method for providing a series of terraces with augmented availability of usable level surface as claimed in claim 3, wherein said at least one gallery opening is provided in a direction generally opposed to the said landscape.

5. A method for providing a series of terraces with augmented availability of usable level surface as claimed in claim 2, wherein each said new uppermost terrace abuts said sloping landscape.

6. A method for providing a series of terraces with augmented availability of usable level surface as claimed in claim 1, wherein said landscape originally comprises a substantially level upper surface.

7. A method for providing a series of terraces with augmented availability of usable level surface as claimed in claim 1, wherein said landscape originally comprises a substantially non-level upper surface, and said upper substantially level surface on said at least one portion of said landscape is provided by depositing a quantity of suitable landfill material on at least said portion of said landscape to form an upper level surface.

8. A method for providing a series of terraces with augmented availability of usable level surface as claimed in claim 7, wherein non-level upper surface constitutes at least part of a valley formed between at least two sloping landscapes.

9. A method for providing a series of terraces with augmented availability of usable level surface as claimed in claim 8, wherein said sloping landscapes each constitute at least part of a mountain or hill.

10. A method for providing a series of terraces with augmented availability of usable level surface as claimed in claim 1, wherein each said gallery support member comprises a substantially horizontal generally semi-cylindrical longitudinal upper shell having an open bottom and a substantially constant transverse cross section.

11. A method for providing a series of terraces with augmented availability of usable level surface as claimed in claim 10, wherein each said gallery support member further comprises a closed horizontal end and an opposed horizontal opening.

12. A method for providing a series of terraces with augmented availability of usable level surface as claimed in claim 10, wherein said transverse cross-section comprises an arcuate profile at least upwards of said enclosed first portion of said upper level surface.

13. A method for providing a series of terraces with augmented availability of usable level surface as claimed in claim 10, wherein said transverse cross-section comprises a polygonal profile at least upwards of aid enclosed first portion of said upper level surface.

14. A method for providing a series of terraces with augmented availability of usable level surface as claimed in claim 10, wherein said enclosed first portion of said upper level surface is substantially coplanar with at least a portion of the said level surface of an adjacent lower terrace.

15. A method for providing a series of terraces with augmented availability of usable level surface as claimed in claim 10, wherein adjacent gallery support members within each terrace may be mutually interconnected by means of one or more subsidiary galleries.

16. A method for providing a series of terraces with augmented availability of usable level surface as claimed in claim 15, wherein said one or more subsidiary galleries are substantially orthogonally oriented in relation to said at least one gallery.

17. A method for providing a series of terraces with augmented availability of usable level surface as claimed in claim 1, wherein a retaining wall is provided between each successive upper terrace and corresponding lower adjacent terrace.

18. A method for providing a series of terraces with augmented availability of usable level surface as claimed in claim 17, wherein said gallery opening is provided on said retaining wall.

19. A method for providing a series of terraces with augmented availability of usable level surface as claimed in claim 18, wherein said retaining wall comprises a substantially planar reinforced concrete construction.

20. A method for providing a series of terraces with augmented availability of usable level surface as claimed in claim 1, further comprising the step of providing a sub-terrace between vertically adjacent terraces.

21. A method for providing a series of terraces with augmented availability of usable level surface as claimed in claim 20, wherein a retaining wall is provided between each sub-terrace and corresponding adjacent terrace.

22. A method for providing a series of terraces with augmented availability of usable level surface as claimed in claim 21, wherein said retaining wall comprises a substantially horizontal generally semi-cylindrical longitudinal upper shell having an open bottom and a substantially constant transverse cross section, said shell having its longitudinal axis substantially parallel to the edge of said terrace.

23. A method for providing a series of terraces with augmented availability of usable level surface as claimed in claim 1, wherein said predetermined depth is at least 4.0 meters.

24. A method for providing a series of terraces with augmented availability of usable level surface as claimed in claim 22, wherein each sub-terrace comprises a minimum depth of 1.5 meters.

25. A method for providing a series of terraces with augmented availability of usable level surface as claimed in claim 1, wherein said at least one gallery support member is provided with at least one skylight to enable natural light to reach at least part of same.

26. A method for providing a series of terraces with augmented availability of usable level surface as claimed in claim 1, wherein said at least one gallery support member is provided with means for providing artificial light therein.

27. A method for providing a series of terraces with augmented availability of usable level surface as claimed in claim 1, wherein each said level surface area in each terrace further comprises an upper layer of suitable material.

28. A method for providing a series of terraces with augmented availability of usable level surface as claimed in claim 27, wherein said suitable material comprising said upper layer includes soil, tarmacadam and concrete.

29. A method for providing a series of terraces with augmented availability of usable level surface us claimed in claim 1, wherein said suitable landfill material includes soil.

30. A method for providing a series of terraces with augmented availability of usable level surface as claimed in claim 1, wherein said method is applied for augmenting surface area suitable for human burial.

31. A method for providing a series of terraces with augmented availability of usable level surface as claimed in claim 1, wherein said method is applied for augmenting surface area suitable for road vehicle parking.

32. A method for providing a series of terraces with augmented availability of usable level surface as claimed in claim 1, wherein said method is applied for augmenting surface area suitable for at least some forms of husbandry.

33. A method for providing a series of terraces with augmented availability of usable level surface as claimed in claim 32, wherein said forms of husbandry include the production of mushrooms and the raising of chickens on a commercial scale.

34. A landscape with augmented level surface area obtained by the method of claim 1.

* * * * *

UNITED STATES PATENT AND TRADEMARK OFFICE

CERTIFICATE OF CORRECTION

PATENT NO. : 5,823,716
DATED : October 20, 1998
INVENTOR(S) : Dray et al.

It is certified that error appears in the above-identified patent and that said Letters Patent is hereby corrected as shown below:

Column 1, line 45, after "available land" please delete "urea" and insert therefor --area--;

Column 4, line 64, after "when laid on", please delete "sail" and insert therefor --said--;

Column 5, line 4, after "polygonal profile", please delete "51" and insert therefor --57--;

Column 5, line 6, after "concrete construction" please delete "through" and insert therefor --though--;

Column 5, line 11, after "157 are laid on" delete "paid" and insert --said--.

Column 8, line 45, after "157 or", please delete "159" and insert therefor --158--.

Signed and Sealed this

Thirteenth Day of February, 2001

Nicholas P. Godici

*Attest:*

NICHOLAS P. GODICI

*Attesting Officer*

*Acting Director of the United States Patent and Trademark Office*